United States Patent [19]

Bloom

[11] Patent Number: 5,005,336

[45] Date of Patent: Apr. 9, 1991

[54] METHOD OF MAKING A HAWAIIAN NUTTY GRAM MAILING RECEPTACLE

[76] Inventor: Melvin R. Bloom, Box 1231, Pahoa, Hi. 96778-1231

[21] Appl. No.: 568,972

[22] Filed: Aug. 17, 1990

[51] Int. Cl.[5] ..... B65B 7/28; B65D 73/00

[52] U.S. Cl. ..... 53/401; 53/471; 53/489; 206/457; 426/132

[58] Field of Search ..... 53/393, 401, 426, 467, 53/468, 471, 489; 206/1.5, 38, 457; 426/104, 132, 321, 489

[56] References Cited

U.S. PATENT DOCUMENTS

| | | | |
|---|---|---|---|
| 1,383,838 | 7/1921 | Mrazek | 206/457 |
| 4,531,635 | 7/1985 | Cleveland | 206/457 |
| 4,795,033 | 1/1989 | Duffy | 206/457 |
| 4,842,140 | 6/1989 | Mesnard | 206/457 |
| 4,899,881 | 2/1990 | Girard et al. | 206/457 |
| 4,911,320 | 3/1990 | Howes | 206/457 X |

*Primary Examiner*—Robert L. Spruill

*Assistant Examiner*—Beth Bianca

*Attorney, Agent, or Firm*—Michael I. Kroll

[57] ABSTRACT

A method of making a mailing receptacle from a coconut, comprising the steps of, making a hole in the coconut so that access to the inner compartment of the coconut can be obtained, draining out the milk of the coconut by way of the hole so that the inner compartment of the coconut becomes dry, filling the coconut with a preserving solution by way of the hole so that the coconut will be preserved, waiting a predetermined period of time so that the preserving solution has preserved the coconut, emptying the coconut of the preserving solution by way of the hole so that the preserving operation is completed, letting the coconut dry so that items can be put into it by way of the hole, inserting items to be mailed into the hole until times drop into the inner compartment of the coconut, and, sealing the hole in the coconut so that the mailing receptacle is ready for transit.

8 Claims, 2 Drawing Sheets

METHOD OF MAKING A HAWAIIAN NUTTY GRAM MAILING RECEPTACLE

BACKGROUND OF THE INVENTION

1. Field of the Invention

The present invention relates to a mailing receptacle. More particularly, the present invention relates to a mailing receptacle made from a coconut.

2. Description of the Prior Art

Unless one has had the personal experience of opening a coconut, it could closely be described as a "tough nut to crack". The present invention is an entirely new idea for the practical jokester, that is, to use a coconut as a mailing receptacle.

Numerous innovations for mailing receptacles have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a mailing receptacle that avoids the disadvantages of the prior art.

More particularly, it is an object of the present invention to make a coconut into a suitable mailing receptacle. The present invention protects the meat in the coconut from becoming infested with maggots, mildewing, and general decomposition of the meat, resulting in extremely offensive odors. The present invention provides a coconut with the meat perfectly preserved, and the interior solid, dry, white, and odor free.

A ½" hole is drilled into the heart of the coconut, and the milk is drained out. The coconut is then injected (filled) with a solution of 2 ounces of formaldehyde, and 2 ounces of methanol, to a gallon of water. This solution is left in the coconut for a period of 96 hours, at which time, the coconut is drained. After a 48 hour drying and airing out period, the coconut is ready for use as a mailing receptacle.

Parents and grandparents enjoy watching a teenager open the present invention, especially, if they have been told that it contains money. The present invention can be used for anything small enough to fit through the ½" hole. Especially, suitable for alimony payments, and contested bills, not to mention hate letters, and traffic tickets.

The present invention can also be used as a security device for hiding valuable items, and/or a decorating device, in addition to a mailing receptacle.

In keeping with these objects, and with others which will become apparent hereinafter, one feature of the present invention resides, briefly stated, in a method of making a mailing receptacle from a coconut, including the steps of, making a hole in the coconut so that access to the inner compartment of the coconut can be obtained, draining out the milk of the coconut by way of the hole so that the inner compartment of the coconut becomes dry, filling the coconut with a preserving solution by way of the hole so that the coconut will be preserved, waiting a predetermined period of time so that the preserving solution has preserved the coconut, emptying the coconut of the preserving solution by way of the hole so that the preserving operation is completed, letting the coconut dry so that items can be put into it by way of the hole, wherein items to be mailed are inserted into the hole until the items drop into the inner compartment of the coconut, and sealing the hole in the coconut so that the mailing receptacle is ready for transit.

When the Hawaiian nutty gram mailing receptacle is designed in accordance with the present invention, a coconut becomes a mailing receptacle.

In accordance with another feature of the present invention, the step of making a hole in a coconut includes the step of making a ½" hole in the coconut.

Another feature of the present invention is that the step of making a ½" hole in the coconut includes the step of using a drill and a drill bit to make the ½" hole in the coconut.

Yet another feature of the present invention is that the step of filling the coconut with a preserving solution includes the step of filling the coconut with a preserving solution of 2 ounces of formaldehyde, and 2 ounces of methanol, to a gallon of water.

Still another feature of the present invention is that the step of waiting a predetermined period of time includes the step of waiting for 96 hours.

Yet still another feature of the present invention is that the step of letting the coconut dry includes the step of letting the coconut dry for 48 hours.

Still yet another feature of the present invention is that the step of sealing the hole in the coconut includes the step of sealing the hole in the coconut with a plug.

Another feature of the present invention is that the step of sealing the hole in the coconut includes the step of sealing the hole in the coconut with plastic wood.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
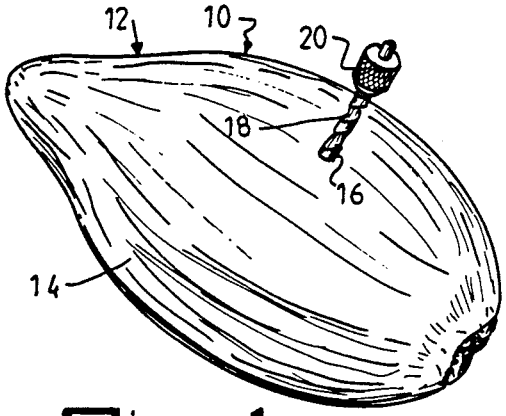
FIG. 1 is a perspective view of the ½" hole being drilled into the coconut.

10—Hawaiian Nutty-Gram Mailing Receptacle of the present invention

12—coconut of the Hawaiian Nutty-Gram Mailing Receptacle 10

14—fiber husk of the coconut 12

16—½" hole in the coconut 12

18—½" drill bit to produce the ½" hole 16 in the coconut 12

18*a*—small hole in coconut 12

20—drill chuck for holding the ½" drill bit 18

22—milk of the coconut 12

24—tub for containing the milk 22

26—flat surface for the tub 24

28—preserving solution replacing the milk 22

30—squeeze bottle containing the preserving solution 28

32—directional arrows indicating the flow of the preserving solution 28

34—spout of the squeeze bottle 30

36—user sender of the Hawaiian Nutty-Gram Mailing Receptacle 10

38—inner compartment of the coconut 12

40—meat of the coconut 12

42—heart of the coconut 12

44—inner hard shell of the coconut 12

46—money in the Hawaiian Nutty-Gram Mailing Receptacle 10

48—ornament in the Hawaiian Nutty-Gram Mailing Receptacle 10

50—plug for the user sender 36

52—user receiver of the Hawaiian Nutty-Gram Mailing Receptacle 10

DETAILED DESCRIPTION OF THE PREFFRRED EMBODIMENT

Referring now to FIG. 1, the Hawaiian Nutty-Gram Mailing Receptacle of the present invention is shown generally at 10. The Hawaiian Nutty-Gram Mailing Receptacle 10 is made from a coconut 12 with the fiber husk 14 in tact.

The Hawaiian Nutty-Gram Mailing Receptacle 10 contains a ½" hole 16, produced by a ½" drill bit 18, which is attached to a drill chuck 20.

Figure 2:
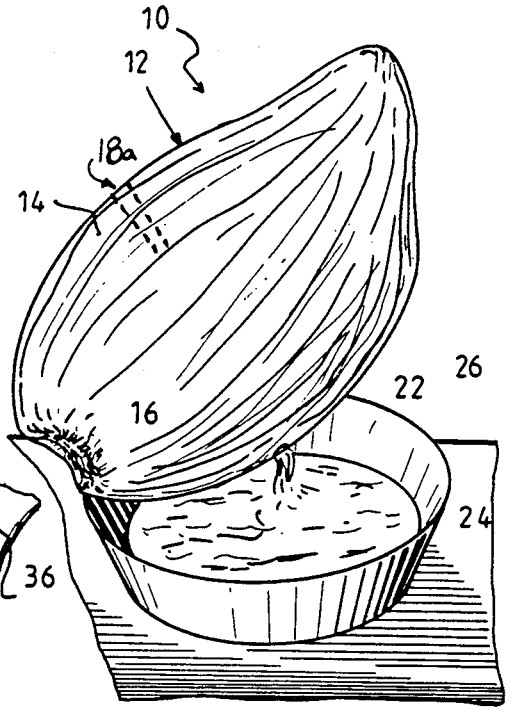
FIG. 2 is a perspective view of the coconut milk being poured out of the ½" hole in the coconut and into a tub.

In FIG. 2, the Hawaiian Nutty-Gram Mailing Receptacle 10 is reoriented so that the ½" hole 16 faces downwardly. Gravity then causes the milk 22 to exit the coconut 12, by way of the ½" hole 16, and enter the tub 24 disposed on a flat surface 26.

Figure 3:
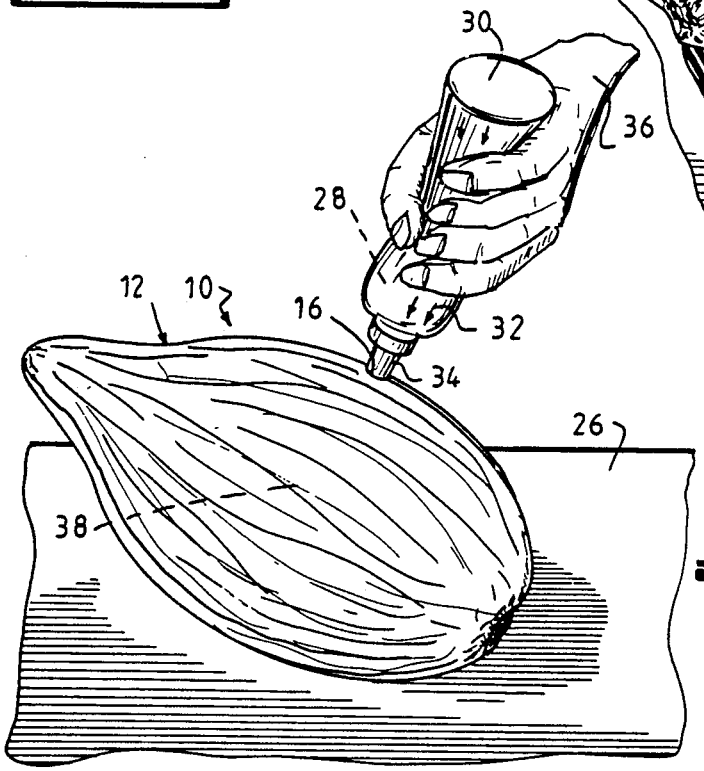
FIG. 3 is a perspective view of the preserving solution being put into the coconut, by a squeeze bottle, through the ½" hole.

As shown in FIG. 3, a preserving solution 28 is placed in a squeeze bottle 30. The preserving solution 28 flows in the direction of arrows 32. The spout 34 of the squeeze bottle 30 is placed into the ½" hole 16. The squeeze bottle 30 is then squeezed by the user sender 36 so that the preserving solution 28 now occupies the inner compartment 38 of the coconut 12.

The preserving solution 28 includes 2 ounces of formaldehyde, and 2 ounces of methanol, added to a gallon of water. However, if the user sender 36 desires not to get involved with the chemistry of the preserving solution 28, the user sender can procure a commercial solution 28 to replace the preserving solution 28. The commercial solution 28 is a Dodge Chemical Plasdoform Based (Metafix) Cavity Chemical, sold by Dodge Chemical Co., Cambridge, Mass. The preserving solution 28 is left within the coconut 12 for 96 hours. A small hole 18*a* is drilled opposite hole 16 after emptying solution to facilitate ventilation and to hasten the drying process.

Figure 4:
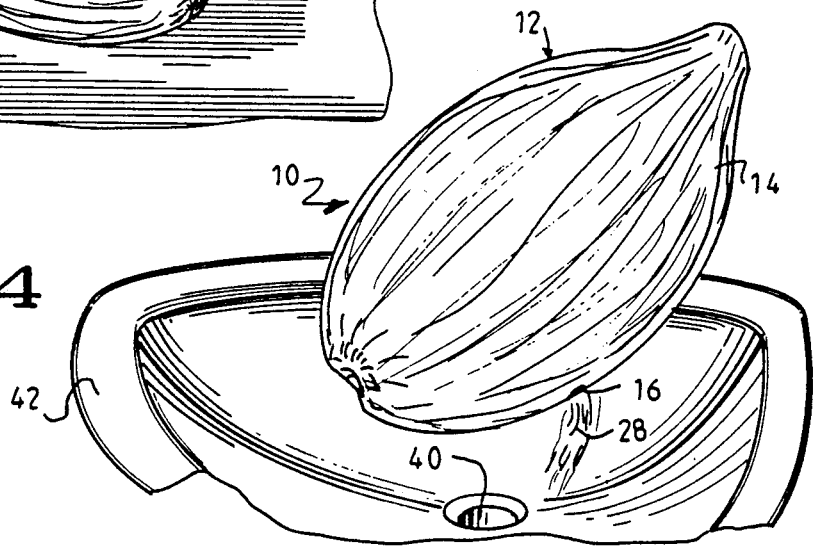
FIG. 4 is a perspective view of the preserving solution, after 96 hours, being poured out of the ½" hole and into a sink, for discarding.

As shown in FIG. 4, the Hawaiian Nutty-Gram Mailing Receptacle 10 is again reoriented so that the ½" hole 16 faces downwardly. Gravity then causes the preserving solution 28 to exit the inner compartment 38, by way of the ½" hole 16, and enter the drain 40 of the sink 42. The coconut 12 is now left to dry for 48 hours, at which point the meat 40 of the coconut 12 is protected from maggots, mildew, and general decomposition of the meat 40, and which is also free of extremely offensive odors. The meat 40 is perfectly preserved, and the interior is solid, dry, white, and odor free.

Figure 5:
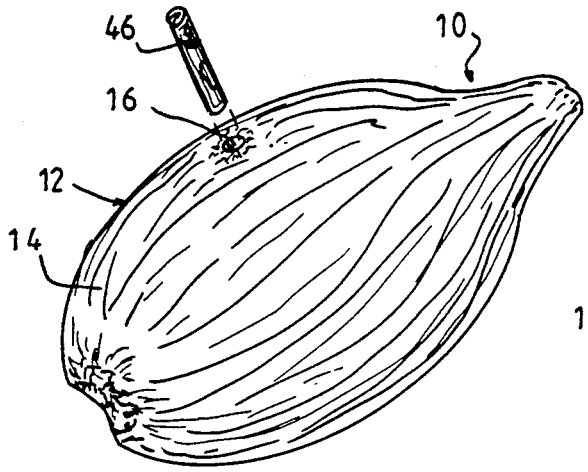
FIG. 5 is a perspective view of rolled up money being inserted into the coconut through the ½" hole, after the coconut has dried for 48 hours.
Figure 6:
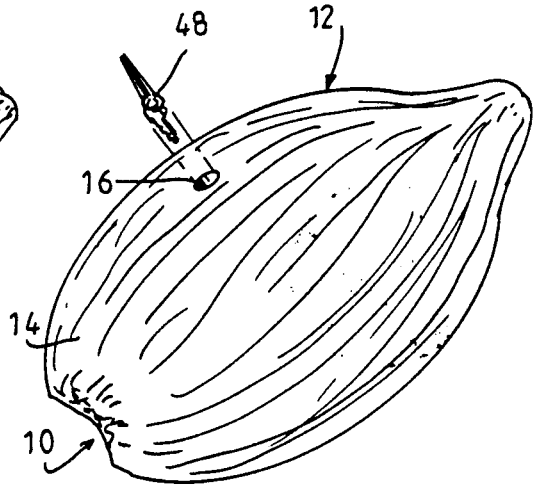
FIG. 6 is a perspective view of a gadget being inserted into the coconut through the ½" hole.

FIGS. 5 and 6 show the Hawaiian Nutty-Gram Mailing Receptacle 10 in operation. In FIG. 5, money 46 is rolled up and put into the ½" hole 16. The money 46 is then pushed down, until the money 46 enters the inner compartment 38 of the Hawaiian Nutty-Gram Mailing Receptacle 10, where it will stay during transit.

In FIG. 6, a gadget 48 is put into the ½" hole 16. The gadget 48 is then pushed down until the gadget 48 enters the inner compartment 38 of the Hawaiian Nutty-Gram Mailing Receptacle 10, where it will stay during transit.

Figure 7:
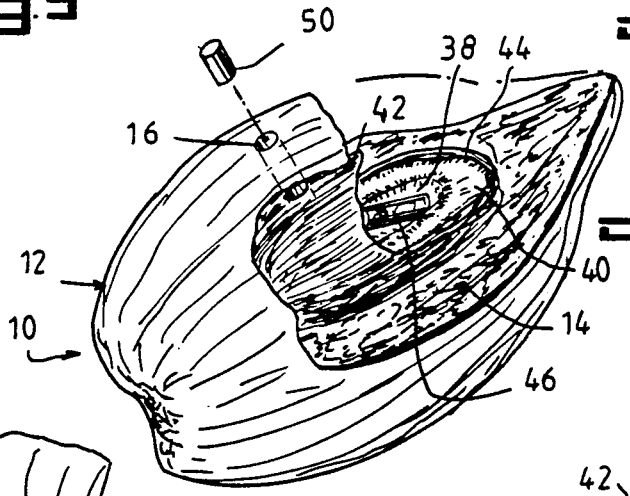
FIG. 7 is a perspective view with parts taken away from the fiber husk and the inner hard shell, and showing the inner compartment.

The money 46 becomes disposed in the inner compartment 38. Since FIG. 7 has part of the fiber husk 14, and the inner hard shell 44 broken away, a clear view of the inner compartment 38 can be seen, along with the money 46.

When the filling of the Hawaiian Nutty-Gram Mailing Receptacle is completed, plastic wood fill or a ½" dowel 50 is inserted into the ½" hole 16. This closes off the ½" hole 16 so that the Hawaiian Nutty-Gram Mailing Receptacle is now ready for transit.

Figure 8:
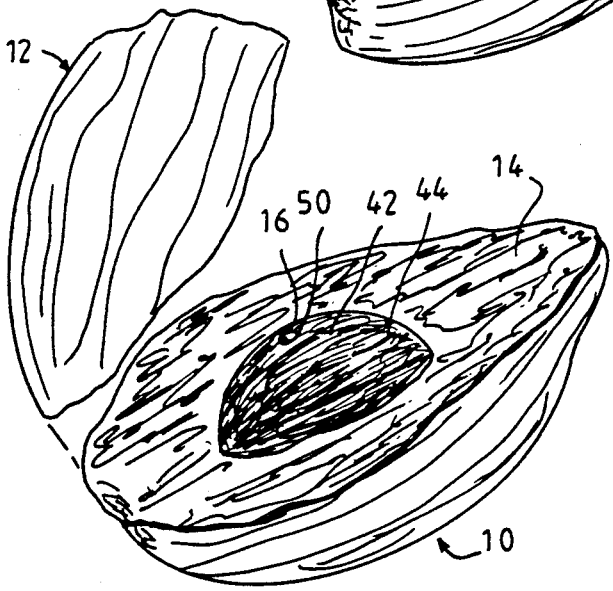
FIG. 8 is a perspective view of the opened fiber husk showing the inner hard shell in tact.
Figure 9:
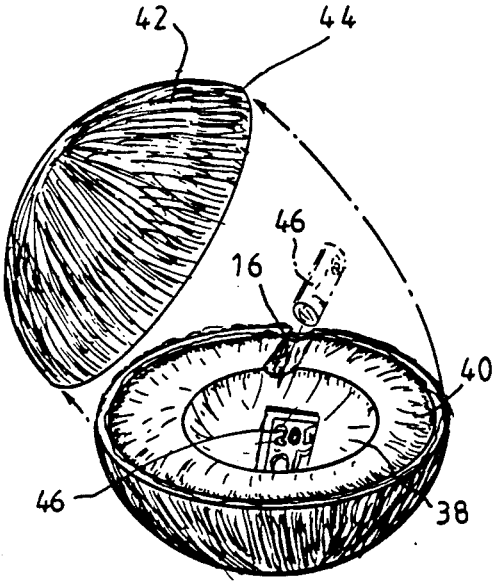
FIG. 9 is a perspective view of the inner hard shell opened and showing the contents of the inner compartment.

When the Hawaiian Nutty-Gram Mailing Receptacle 10 is received by the user receiver 62, the fiber husk is removed from around the heart 42 of the inner hard shell 44, as shown in FIG. 8. In FIG. 9, the inner hard shell 44 is broken open and reveals the money 46 disposed in the inner compartment 38. Additionally, there are no signs of maggots, mildew, or any general decomposition of the meat, and no extremely offensive odors.

It will be understood that each of the elements described above, or two or more together, may also find a useful application in other types of constructions differing from the type described above.

While the invention has been illustrated and described as embodied in a mailing receptacle, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of making a mailing receptacle from a coconut, comprising the steps of:

(a) making a hole in the coconut so that access to the inner compartment of the coconut can be obtained;

(b) draining out the milk of the coconut by way of the hole so that the inner compartment of the coconut becomes dry;

(c) filling the coconut with a preserving solution by way of the hole so that the coconut will be preserved;

(d) waiting a predetermined period of time so that the preserving solution has preserved the coconut;

(e) emptying the coconut of the preserving solution by way of the hole so that the preserving operation is completed;

(f) letting the coconut dry so that items can be put into it by way of the hole;

(g) inserting items to be mailed into the hole until the items drop into the inner compartment of the coconut; and (h) sealing the hole in the coconut so that the mailing receptacle is now ready for transit.

2. A method as defined in claim 1, wherein said step of making a hole in a coconut includes the step of making a ½" hole in the coconut.

3. A method as defined in claim 2, wherein said step of making a ½" hole in the coconut includes the step of using a drill and a drill bit to make the ½" hole in the coconut.

4. A method as defined in claim 3, wherein said step of filling the coconut with a preserving solution includes the step of filling the coconut with a preserving solution of 2 ounces of formaldehyde, and 2 ounces of methanol to a gallon of water.

5. A method as defined in claim 4, wherein said step of waiting a predetermined period of time includes the step of waiting for 96 hours.

6. A method as defined in claim 5, wherein said step of letting the coconut dry includes the step of letting the coconut dry for 48 hours.

7. A method as defined in claim 6, wherein said step of sealing the hole in the coconut includes the step of sealing the hole in the coconut with a plug.

8. A method as defined in claim 6, wherein said step of sealing the hole in the coconut includes the step of sealing the hole in the coconut with plastic wood.

* * * * *